US007108522B2

(12) United States Patent
Verelst et al.

(10) Patent No.: US 7,108,522 B2
(45) Date of Patent: Sep. 19, 2006

(54) CONNECTOR ASSEMBLING WITH SIDE GROUNDING PIN

(75) Inventors: Koen Verelst, Brasschaat (BE); Gert Droesbeke, Geel (BE)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/506,629

(22) PCT Filed: Mar. 4, 2003

(86) PCT No.: PCT/EP03/02244

§ 371 (c)(1),
(2), (4) Date: Jul. 11, 2005

(87) PCT Pub. No.: WO03/075411

PCT Pub. Date: Sep. 12, 2003

(65) Prior Publication Data

US 2006/0166530 A1 Jul. 27, 2006

(30) Foreign Application Priority Data

Mar. 5, 2002 (NL) ..... 1020115

(51) Int. Cl.
*H01R 13/652* (2006.01)

(52) U.S. Cl. ..... 439/108; 439/607

(58) Field of Classification Search ..... 439/607, 439/609, 108, 92, 95, 701, 540.5, 74
See application file for complete search history.

(56) References Cited

U.S. PATENT DOCUMENTS 4,655,518 A * 4/1987 Johnson et al. ..... 439/62
5,104,329 A * 4/1992 Brown et al. ..... 439/108
5,176,526 A * 1/1993 Hillbish et al. ..... 439/108
5,176,538 A * 1/1993 Hansell et al. ..... 439/607
5,511,992 A * 4/1996 Thalhammer ..... 439/609
5,522,731 A * 6/1996 Clark et al. ..... 439/108
5,967,806 A 10/1999 Patterson ..... 439/108
6,183,281 B1 * 2/2001 Wu et al. ..... 439/260
6,273,758 B1 * 8/2001 Lloyd et al. ..... 439/607
6,371,813 B1 * 4/2002 Ramey et al. ..... 439/608
6,375,496 B1 * 4/2002 Casey et al. ..... 439/541.5

FOREIGN PATENT DOCUMENTS

EP 1180822 A1 2/2002

* cited by examiner

*Primary Examiner*—Alexander Gilman
(74) *Attorney, Agent, or Firm*—Harrington & Smith, LLP

(57) ABSTRACT

A connector is adapted for mating with a header with one or more side grounding pins. The connector comprises a first insulating connector body part with one or more receiving spaces for a side grounding pin, a conductive shield, substantially covering a first face of the connector body part, and one or more outer flexible beams, in electrical contact with the shield, and each protruding into a receiving space. The connector comprises one or more inner flexible beams, each positioned relative to an outer flexible beam so as to make contact with the outer flexible beam when it is forced out of the receiving space.

8 Claims, 5 Drawing Sheets

CONNECTOR ASSEMBLING WITH SIDE GROUNDING PIN

FIELD OF THE INVENTION

The invention relates to a connector adapted for mating with a header with one or more side grounding pins, comprising a first insulating connector body part with one or more receiving spaces for a side grounding pin, a conductive shield, substantially covering a first face of the connector body part, and one or more outer flexible beams, in electrical contact with the shield, and each protruding into a receiving space and to a connector assembly comprising a plurality of such connectors.

BACKGROUND OF THE INVENTION

Embodiments of such a connector and assembly are known. One example comprises a stackable configuration of connectors with ground tabs to mate with the optional side grounding pins in a mating header. Each connector has its own shield.

The conductive shield in such a connector is used for grounding. The conductive contact between the connector and the grounding pins of the header must therefore have a very low resistance, to take account of the low currents and voltage differences. Low resistance can be provided through high contact pressure between each flexible beam and its associated grounding pin. At the same time, plastic deformation of either the side grounding pin or the flexible beam should be prevented, so as to be able to repeatedly exert the same contact pressure. The flexible beam may not be very long either, since this would create extra inductance, leading to deteriorated shielding performance.

The known connector does not fully meet these requirements. To exert sufficient force, the beams must be made relatively thick, resulting in less flexibility. In addition, since only one face of the connector is covered by a conductive shield, the conductor is asymmetric, giving rise to impedance 'steps' and, consequently, sub-optimal shielding of high frequency signals.

SUMMARY OF THE INVENTION

It is an object of the invention to provide a connector and connector assembly of the type mentioned above with better shielding properties.

Accordingly, the connector according to the invention is characterised in that the connector comprises one or more inner flexible beams, each positioned relative to an outer flexible beam so as to make contact with the outer flexible beam when it is forced out of the receiving space.

Thus, the contact pressure between outer beam and side grounding pin is the result of the flexing of two beams, instead of only the outer beam. It is thus possible to provide beams that are more flexible, or to position the beams in such a way that they are bent over a smaller angle when the outer flexible beam is forced out of the receiving space through contact with a side grounding pin. In this way, plastic deformation is prevented. The contact pressure therefore does not change through repeated flexing by the side grounding pin.

According to an aspect of the invention, the connector comprises a second conductive shield located on a face of the connector opposite the first face and in electrical contact with the first conductive shield.

Thus, a more symmetric type of shielding is provided. This helps to eliminate abrupt and large changes in local impedance, thus ensuring that the shielding is more effective at high frequencies.

In the preferred embodiment of the invention, at least one inner flexible beam is in electrical contact with the second conductive shield.

Thus, effective contact between the two conductive shields is ensured, providing a shielding that substantially encases the entire conductor.

According to an aspect of the invention, each beam is an integral part of a cover shield.

Thus, no separate parts are needed for the inner flexible beam or the outer flexible beam. Since in almost all applications, the dimensions of this beam will be small, avoiding handling, tooling, and mounting operations of a beam provided as a separate part makes manufacturing much easier and less expensive. Tolerances in the positioning of the inner flexible beam can also be much smaller.

In a preferred embodiment, the inner flexible beam is in contact with the outer flexible beam when the outer flexible beam protrudes into the receiving space.

Thus, the inner and outer flexible beams both flex from the moment the outer flexible beam makes contact with an inserted side grounding pin. In this way, full use is made of the extra contact pressure provided by the inner flexible beam. In addition, the build-up of the contact pressure is more gradual.

According to a further aspect of the invention, the inner flexible beam is part of a rim of a conductive shield and the outer flexible beam covers the inner flexible beam and adjacent cut out areas of the rim.

Thus, no holes in the protective shielding occur. This also contributes towards realising the aim of providing an effective shielding that is also useable in the high-frequency range.

According to an aspect of the invention, at least the outer flexible beam has a distal portion, which is bent away from the receiving space.

This allows the provision of a long outer beam, covering the inner beam, whilst keeping the point of contact with an inserted side grounding pin away from the leading end of the pin. As mentioned above, this is undesirable, since the inductance of the connection between cover shield and side grounding pin increases as the point of contact is moved further towards the leading end of the pin.

The connector assembly according to the invention comprises a plurality of connectors according to any one of claims 1–7.

BRIEF DESCRIPTION OF THE DRAWINGS

An embodiment of the invention will now be explained in further detail with reference to the appended drawings.

DETAILED DESCRIPTION OF THE INVENTION

Figure 1:
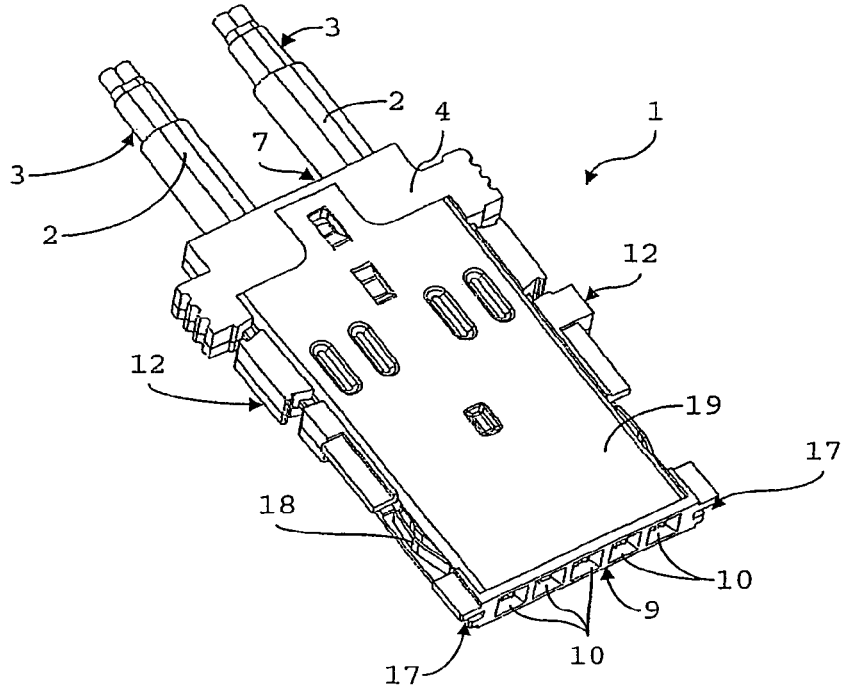
FIG. 1 is a perspective view of an embodiment of the cable connector according to the invention.

A cable connector 1 according to the invention is shown in perspective in FIG. 1. The connector 1 terminates two twin-axial cables 2, each provided with a shield 3, to prevent distortion of signals carried on the cables 2 by external electromagnetic interference. The body of the connector 1 is provided by a housing 4. This housing 4 is made of an insulating material, e.g. a plastic such as a glass filled polyester, or similar composite. Other materials are possible.

In the shown embodiment of the invention, the connector housing 4 is made up of two halves: a lower cover part 5, and an upper cover part 6. Perspective views of the inside of the lower and upper cover part 5, 6 are provided by FIGS. 3 and 7, and FIGS. 4 and 8 respectively.

The cables 2 enter the housing 4 at a rear edge 7. The wires are electrically connected to terminals 8, visible in FIG. 3, disposed inside the housing 4, in this case of the female variety. At a front edge 9 of the housing 4, there are five terminal openings 10, arranged in a row and providing access to the terminals 8.

The top face of the connector 1 is substantially covered by a conductive shield 11. The shield 11 can be made of metal, for instance a copper alloy or INOX, although other choices of material are possible. At its edges, the conductive shield 11 partly wraps round side edges 12 of the housing 4, thereby forming rims 13, which can be seen in FIG. 4.

Figure 2:
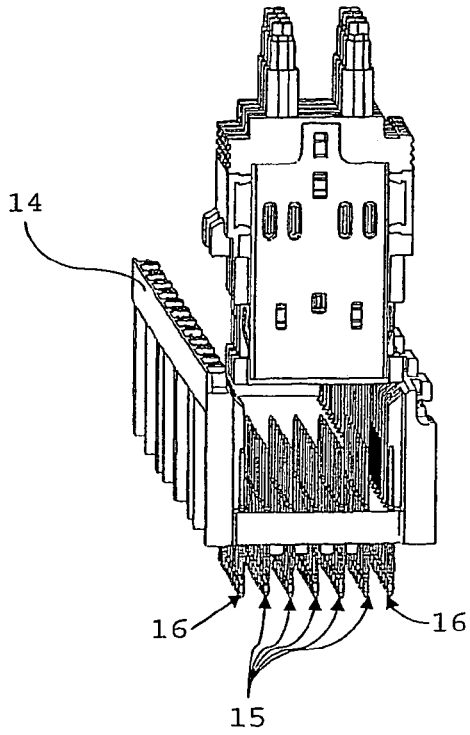
FIG. 2 is a perspective view of the connector assembly according to the invention, comprising a stack of connectors of the type shown in FIG. 1, prior to mating with a suitable header with side grounding pins.
Figure 3:
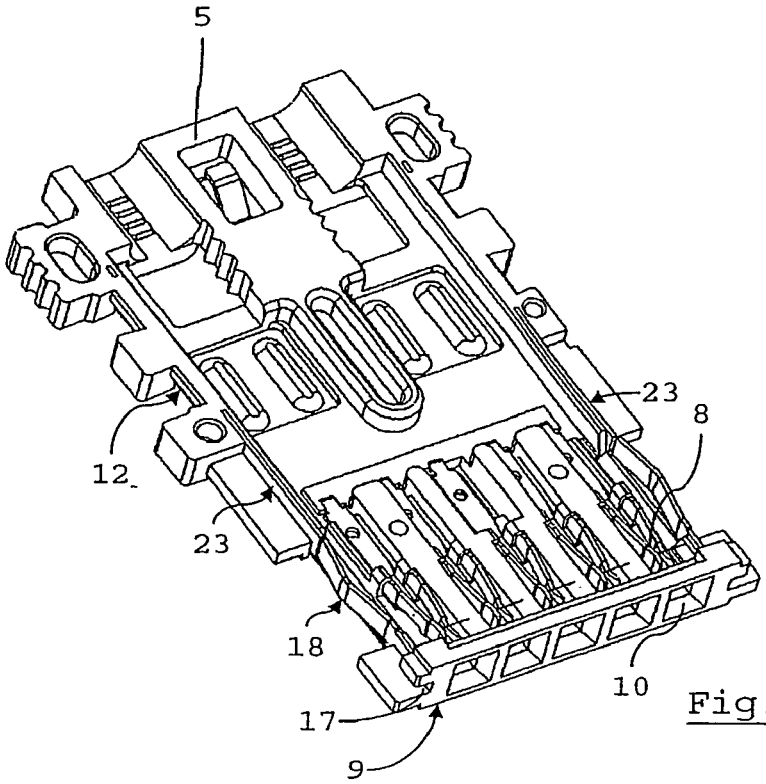
FIG. 3 is a perspective view of the inside of a lower cover part of a housing comprised in the connector of FIG. 1.

The connector 1 shown in FIG. 1 is ideally suited for connection to a header 14 such as the one shown in FIG. 2. Such headers are primarily intended for fixing to printed circuit boards. A plurality of connectors 1, preferably in a stacked assembly, can be connected to the header 14, as is apparent from FIG. 2. The assembly of connector 1 and header 14 can thus be used to connect the cables 2 to conductive tracks on a printed circuit board. The header 14 of FIG. 2 is of the male variety, provided with contact pins 15, arranged in a matrix, with five in a row. Upon mating of the connector 1 with the header 14, the contact pins 15 are inserted into the terminal openings 10, and are received by the terminals 8 disposed inside the housing 4.

In addition to the five contact pins 15, the header comprises two side grounding pins 16 for each row, located at either end of the row. When the connector 1 is mated with the header 14, these side grounding pins 16 are received in receiving spaces formed by slots 17 present at each side edge 12 of the connector 1. The slots provide a degree of protection to the side grounding pin 16, but are not essential to the invention. The term receiving space is used here generally to refer to the space occupied by a side grounding pin 16, when the header 14 and connector 1 are connected, irrespective of the particular geometry of the connector housing 4.

The connector comprises a flexible outer beam 18, positioned at an angle ato the side edge 12 of the connector 1, so as to protrude into the receiving space for a side grounding pin 16. When the side grounding pin 16 is inserted into the space provided for receiving it, it makes contact with the outer flexible beam 18, forcing it out of the receiving space. In the mated position, each side grounding pin 16 maintains electrical and mechanical contact. The flexible outer beam 18 applies a contact pressure to the side grounding pin 16, due to the fact that it is flexed through contact with the side grounding pin 16.

According to the invention, the connector 1 is provided with a lower conductive shield 19, such that the outer face of each of the cover parts 5, 6 is substantially covered by one of the conductive shields 11, 19. The lower conductive shield 19 is in electrical contact with the upper conductive shield 11, thus encasing the connector.

In the shown embodiment, the upper cover part 6 is covered by the first mentioned shield 11, and the outward looking face of the lower cover part 5, i.e. the face of the connector 1 opposite to the outer face provided by the upper cover part 6, is substantially covered by the lower, i.e. second, conductive shield 19, of which the flexible outer beam 18 forms an integral part. Of course, it could just as well have been the other way round. That is, the outer flexible beam 18 could have been part of the upper conductive shield 11, forming an integral part of it.

Figure 5:
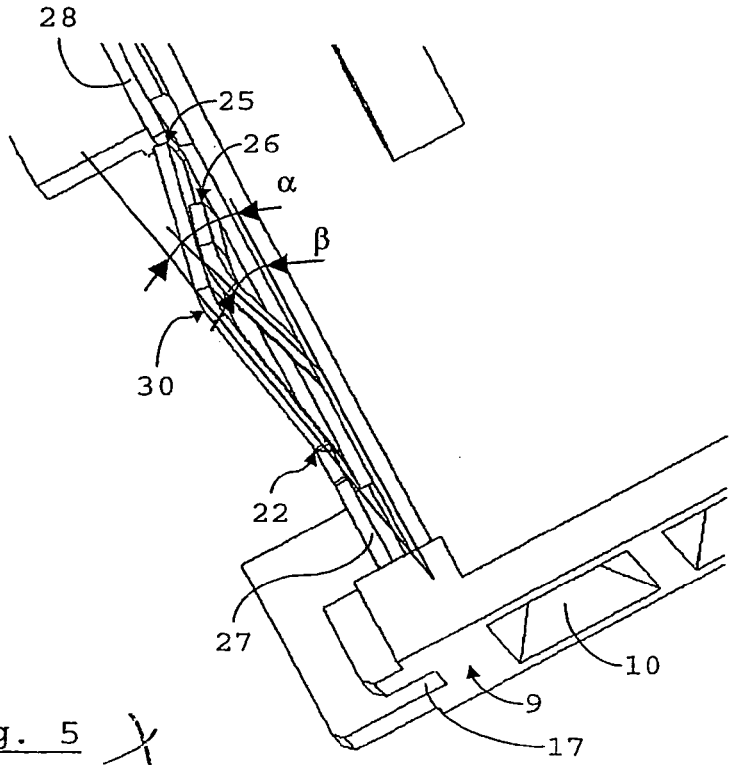
FIG. 5 is a detailed view of the configuration of inner and outer flexible beams in the connector.

According to the invention, the connector 1 comprises an inner flexible beam 20 for each outer flexible beam 18, disposed along a side edge 12, and positioned at an angle β to this side edge 12. The relation between the angles, and the relative locations along the side edge 12 of the inner and outer flexible beams 20, 18 are such that an inner flexible beam 20 is flexed through contact with an associated outer flexible beam 18, when the latter is forced out of the receiving space for a side grounding pin 16. FIG. 5 shows the inner flexible beam 20 and its relation to the outer flexible beam 18 in more detail.

Figure 6:
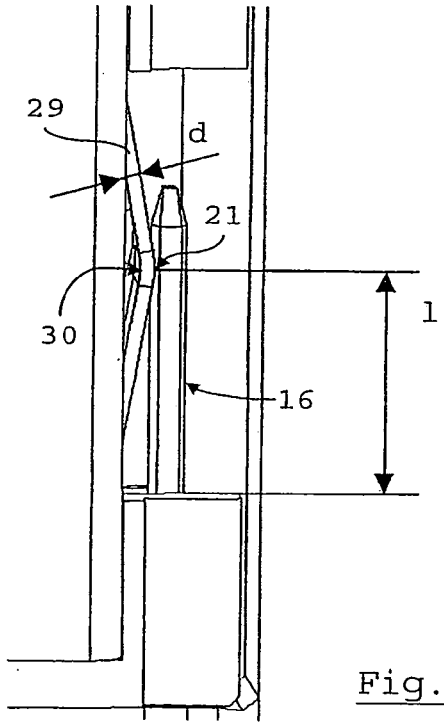
FIG. 6 shows the interaction between a side grounding pin of the header and the flexible beams of the connector.

FIG. 6 illustrates some of the design issues for the connector. One of the principal specifications for the connector 1 is that the contact between the conductive shields 11, 19 and the side grounding pins 16 have as low impedance as possible. Both the resistance and the inductance must be small. The reluctance can be kept low by keeping the path from the point where the side grounding pin 16 protrudes from the header 14 to the point of contact 21 between outer beam 18 and side grounding pin 16 and the path from the proximal end 22 of the beam 18 to the point of contact 21, as short as possible. The proximal end 22 of the beam 18 is the end at which it is attached to the shielding. Beam 18 and side grounding pin 16 function as an antenna along these paths, picking up interference from the environment. In effect, this requirement means that the distance from the header 14 to the point of contact 21, denoted as 1 in FIG. 6, must be kept small. The resistance of the contact depends primarily on the contact pressure between the flexible outer beam 18 and the side grounding pin 16.

Previously, these requirements have been met by providing very stiff and short flexible outer beams 18, for instance beams 18 with a relatively large thickness d. The shorter the length 1, the larger the thickness d must be to provide the required contact pressure. This approach has a number of drawbacks: firstly, the contact pressure is very dependent on the angle a between the flexible outer beam 18 and the side edge 12. Variations in this angle a lead to large variations in the contact pressure. Also, it is very difficult to guarantee that the required contact pressure can be repeatedly reached. Thick beams have a tendency to quickly reach the limit of elasticity. Beyond this limit, the flexing of the beam is non-reversible, so that the angle a will have changed after repeated mating of the connector 1 with a header 14. The same holds true for the side grounding pin 16, which can also deform slightly over its lifetime.

The approach taken by the present invention does not lead to such disadvantages. Due to the fact that the inner flexible beam 20 also plays a part in the build-up of the contact pressure, the inner and outer flexible beams 20, 18 can have a lower thickness, and/or the length 1 can be decreased. The former measure serves to diminish the amount of plastic deformation, thus making it possible to guarantee the specified contact pressure after the connector 1 has been mated with a header 14 a number of times. The latter measure lowers the inductance, allowing more effective shielding at higher frequencies.

The angle β of the inner flexible beam 20 to the side edge 12 is preferably greater than the angle α of the outer flexible beam 18 to the side edge 12. In this way, the inner flexible beam 20 is in contact with the associated outer flexible beam 18, when the latter protrudes into the receiving space for a side grounding pin 16. Therefore, the inner flexible beam 20 is flexed the moment the outer flexible beam 18 is flexed due to contact with a side grounding pin 16. This provides the largest contact pressure, in addition to ensuring that the two conductive shields 11, 19 are always in electrical contact.

Figure 4:
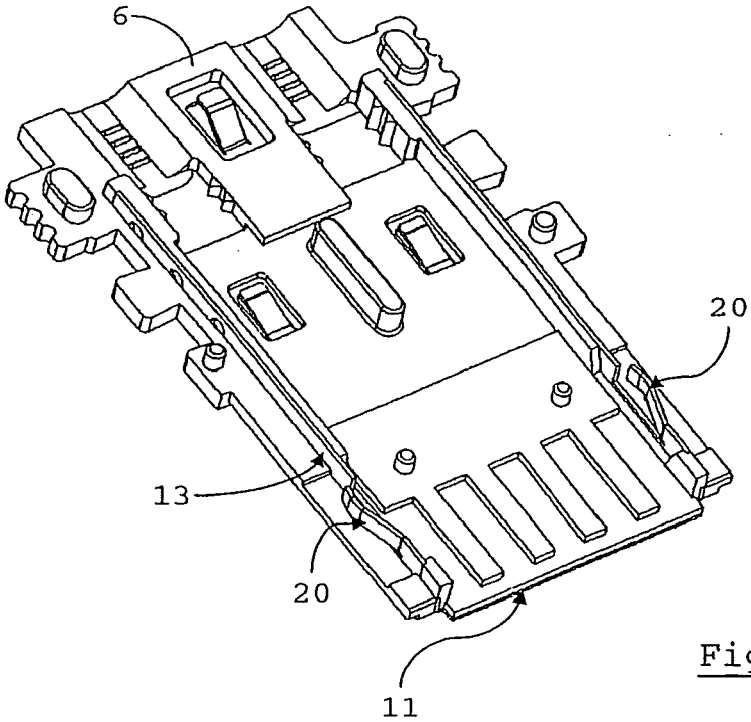
FIG. 4 is a perspective view of the inside of an upper cover part of a housing comprised in the connector of FIG. 1.

As can be seen from FIG. 4, each inner flexible beam 20 is an integral part of the upper conductive shield 11, in the same manner as each outer flexible beam 18 is an integral part of the lower conductive shield 19, and not a separate part. There are thus no extra small parts, making manufacturing much easier. No extra tooling is needed and no soldering, welding or riveting of such a small part as the beam is needed. Handling of the conductive shields 11, 19 is also much easier than handling a tiny part. In addition, only the tolerances in the manufacturing and in the positioning of the shields 11, 19 affect the position of the beams 18, 20 along the side edge 12, and as a consequence, the distance 1 along the side grounding pin 16 to the point of contact 21. If the beams 18, 20 were to be separate parts, manufacturing tolerances for both beams 18, 20 and shields 11, 19 and tolerances in the positioning of each of these would affect the position of the beams 18, 20, making the tolerance chain for the position of the beams 18, 20 relative to the inserted side grounding pins 16 longer.

In an advantageous embodiment of the invention, the shields 11, 19 with integrated beams 18, 20 are made from a single stamped and formed metal plate. They, or only the beams 18, 20, can also be plated to give the beams 18, 20 the desired conductive properties. For example, they can be plated with gold or nickel or an alloy thereof.

Because the invention makes it possible to provide a high contact pressure without suffering the drawbacks of plastic deformation or high inductance, it may be possible to dispense with plating. This would be the case if the higher contact pressure by itself were to be sufficient to provide the (low) contact resistance required for a particular application of the connector.

Since the beams 20, 18 are an integral part of the conductive shields 11, 19, the fact that they make contact with each other when flexed through contact with the side grounding pin 16, allows for better contact between the two conductive shields 11, 19. This diminishes impedance jumps between the shields 11, 19. A complete enclosure of the housing 4 by a symmetric shielding is also much more effective at high frequencies.

Another measure helping to ensure the complete enclosure of the housing 4 is the fact that the shields 11, 19 have rims 13 and 23 respectively, extending along the side edge 12. The flexible beams 18, 20 are stamped from these rims and connected to them at their proximal ends 22, 24. It is noted that in the shown embodiment, the flexible beams 18, 20 are oriented in such a way that their proximal ends 22, 24 are closer to the front edge 9 of the connector 1 than their distal ends 25, 26. This is true for both the inner and the outer flexible beams 20, 18. However, within the scope of the invention, it is also possible that either the inner or the outer beam 20, 18, or both are oriented in opposite direction. Thus, an inner beam 20 can be oppositely oriented or run substantially parallel to the associated outer beam 18. The proximal end 22, 24 of either beam 18, 20 can be attached to a rim section 27 extending from the front end of the connector 1 or to a section 28 extending from the rear edge 7 of the connector 1.

This freedom of orientation is afforded more in particular by the beam shape in the embodiment shown in the figures, wherein the inner and outer beams 20, 18 have a distal portion 29 that is bent towards the side edge 12 to form a bend 30. In other words, the distal portion 29 is bent away from the receiving space. Thus, the location of the point of contact 21 is determined by the location of the bend 30. Thus, the distance 1 from the point where the side grounding pin 16 protrudes from the header 14 to the point of contact 21 between the side grounding pin 16 and the corresponding outer beam 18 is independent of the length of the outer beam 18. The distance is only determined by the location of the bend and the angle α of the outer beam 18 to the side edge 12. Since the length of the beam can be set independently of the other two parameters, the resultant design is less of a compromise, meaning that the finished product is better able to fulfil the requirements specified for a particular application accurately and consistently.

Figure 7:
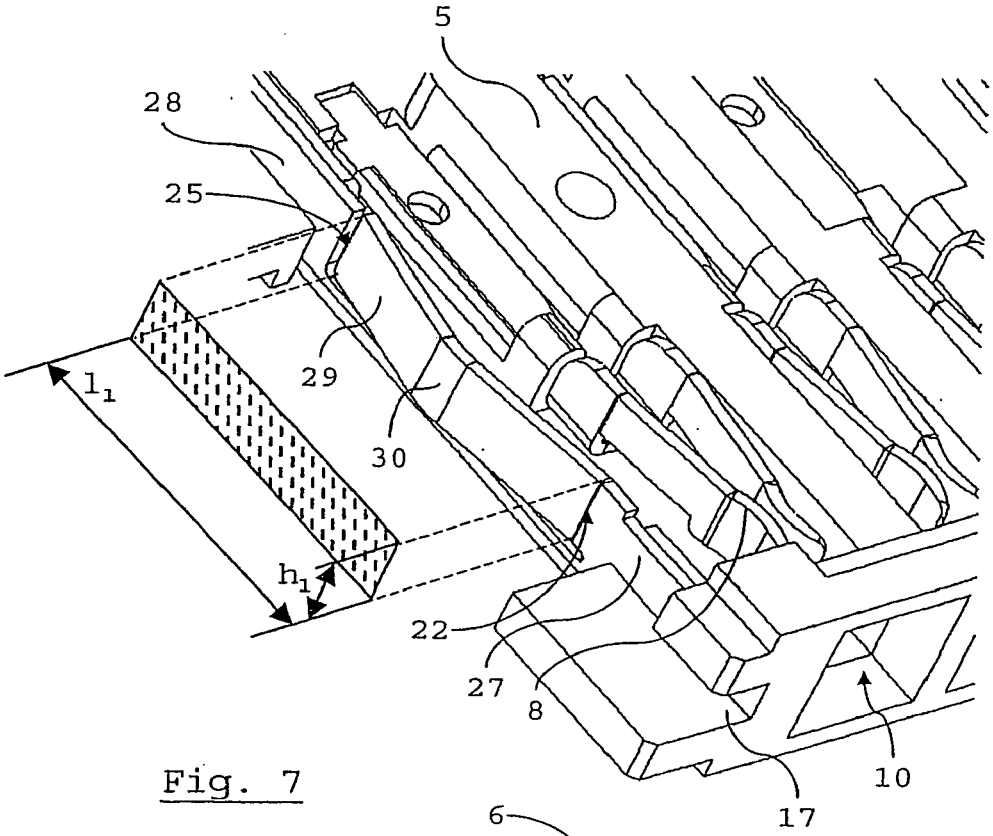
FIG. 7 is a more detailed view of the lower cover part and outer flexible beam of the connector.
Figure 8:
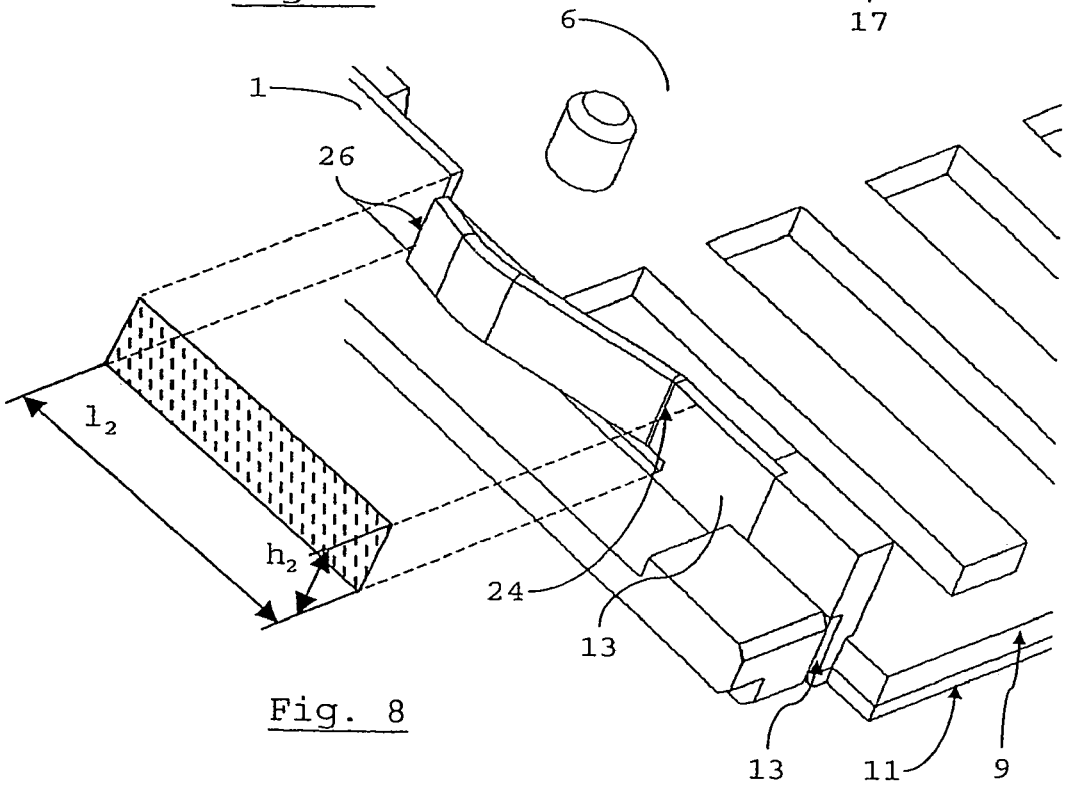
FIG. 8 is a more detailed view of the upper cover part and inner flexible beam of the connector.

It is preferred to make use of the fact that the length of the outer and inner beams 18, 20 can vary within a certain range without affecting the point of contact 21 to the side grounding pin 16. FIGS. 5, 7 and 8 show that the outer flexible beam 18 extends along the side edge 12 over a larger distance than the inner flexible beam 20. The outer flexible beam 18 covers the inner flexible beam 20 and adjacent cut out areas of the rim 13, of which the inner flexible beam 20 is a part. Thus, the inner flexible beam 20 and gaps around its edge, due to stamping, forming and the fact that it is bent outwards at an angle β to the side edge 12, are completely covered by the associated outer flexible beam 18.

The outer flexible beam 18 covers an imaginary area, projected in a direction perpendicular to the side edge 12, as shown in FIG. 7. An area defined by the inner beam 20 and all openings in the rim 13 of the upper conductive shield 11 due to stamping, forming and bending of the inner beam 20, is shown in FIG. 8. Length and height of this latter area are denoted as $l_2$ and $h_2$, respectively. In the preferred embodiment of the invention shown here, the area covered by the outer beam 18 has a larger length $l_1$ and height $h_1$ than the length $l_2$ and height $h_2$ of the inner flexible beam 20.

The advantage of this arrangement is to ensure that a complete shielding of the connector 1 is provided. The shielding completely encases the housing 4, leaving no gaps. In addition, it is more difficult for dust or small foreign bodies to enter the connector 1 through the side edges 12 in this configuration.

Figure 9:
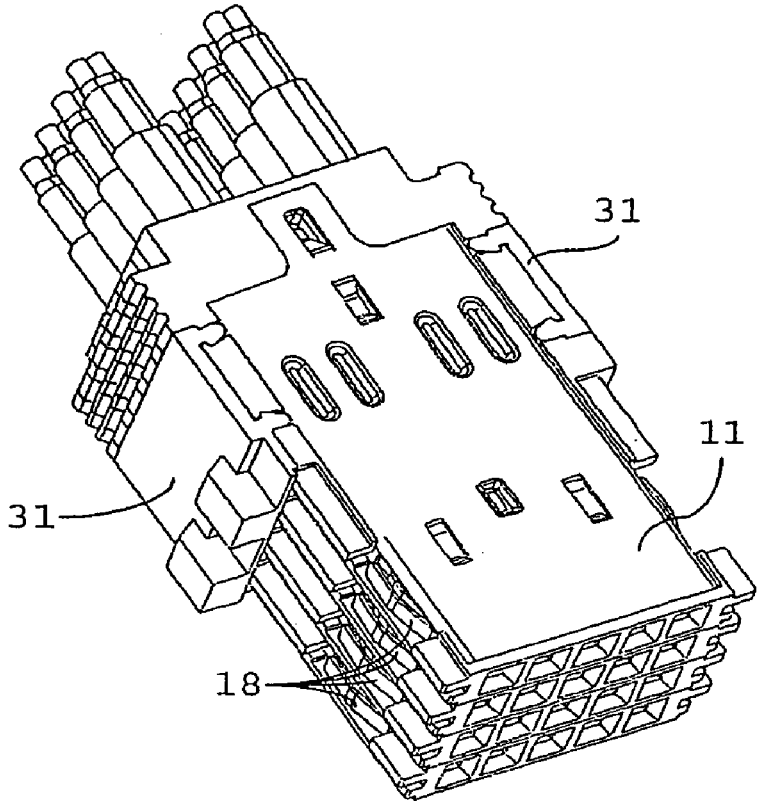
FIG. 9 is a perspective view of a connector assembly according to the invention.

As shown in FIG. 9, the described embodiment of the connector according to the invention is stackable. Locking clips 31 keep the connectors 1 aligned relative to each other and hold them in position. Preferably, the upper conductive shield 11 of a connector 1 is in contact with the lower conductive shield 19 of a connector 1 stacked on top of it. In this way, a complete shielding of the entire assembly is achieved. Because the connectors 1 comprise both a lower and an upper conductive shield 19, 11, there is a shield on either side of the stack, so that the terminals 8 of all the connectors 1 are enclosed by the shielding.

It will be apparent to those skilled in the art that the invention is not limited to the embodiment described above, which can be varied in a number of ways within the scope of the attached claims. For example, it is not a necessary aspect of the invention, that there be only one outer and inner flexible beam 18, 20 for each side edge 12 of the connector, nor that each outer flexible beam have an associated inner flexible beam if several outer flexible beams are provided for each side grounding pin.

The invention claimed is:

1. Connector adapted for mating with a header with one or more side grounding pins, comprising a first insulating connector body part with one or more receiving spaces for a side grounding pin, a conductive shield substantially covering a first face of the connector body part, and one or more outer flexible beams, in electrical contact with the shield, and each protruding into a receiving space, characterised in that the connector comprises one or more inner flexible beams, each positioned relative to an outer flexible beam so as to make contact with the outer flexible beam when the outer flexible beam is forced out of the receiving space.

2. Connector according to claim 1, wherein each beam is an integral part of a conductive shield.

3. Connector according to claim 1, wherein the inner flexible beam is in contact with the outer flexible beam when the outer flexible beam protrudes into the receiving space.

4. Connector according to claim 1, wherein the inner flexible beam is part of a rim of a conductive shield and the outer flexible beam covers the inner flexible beam and adjacent cut out areas of the rim.

5. Connector according to claim 1, wherein at least the outer flexible beam has a distal portion, which is bent away from the receiving space.

6. Connector assembly, comprising a plurality of connectors according to claim 1.

7. Connector according to claim 1, wherein the connector comprises a second conductive shield located on a face of the connector opposite the first face and in electrical contact with the first conductive shield.

8. Connector according to claim 7, wherein at least one inner flexible beam is in electrical contact with the second conductive shield.

* * * * *